US005450093A

United States Patent [19]

Kim

[11] Patent Number: 5,450,093

[45] Date of Patent: Sep. 12, 1995

[54] CENTER-FED MULTIFILAR HELIX ANTENNA

[75] Inventor: Chang S. Kim, Mystic, Conn.

[73] Assignee: The United States of America as represented by the Secretary of the Navy, Washington, D.C.

[21] Appl. No.: 230,459

[22] Filed: Apr. 20, 1994

[51] Int. Cl.[6] ..... H01Q 1/36

[52] U.S. Cl. ..... 343/895; 343/859; 343/853

[58] Field of Search ..... 343/895, 890, 891, 893, 343/850, 853, 857, 858, 859; H01Q 1/36

[56] References Cited

U.S. PATENT DOCUMENTS 3,449,657 6/1969 Fredriksson et al. ..... 343/895
3,503,075 3/1970 Gerst ..... 343/895
3,521,289 7/1970 Mayes et al. ..... 343/895
3,940,772 2/1976 Ben-Dov ..... 343/895
5,170,176 12/1992 Yasunaga et al. ..... 343/895

*Primary Examiner*—Donald Hajec
*Assistant Examiner*—Hoanganh Le
*Attorney, Agent, or Firm*—Michael J. McGowan; Prithvi C. Lall; Michael F. Oglo

[57] ABSTRACT

An antenna system including a phasing circuit for producing balanced, phase displaced, signals for connection to an antenna. The antenna comprises, for each set of balanced phase signals, a pair of antenna elements disposed serially along a helical path. A transmission line, connected to each of the phasing circuit terminals, drives each antenna element pair at a center location by being connected to the proximate ends of each pair. The antenna has a omnidirectional radiation pattern, a wide band width, a good front-to-back ratio and can be constructed in a compact form.

12 Claims, 3 Drawing Sheets

CENTER-FED MULTIFILAR HELIX ANTENNA

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to antennas and more specifically to antennas characterized by omnidirectional radiation patterns.

(2) Description of the Prior Art

Numerous communication networks utilize omnidirectional antenna systems to establish communications between various stations in the network. In some networks one or more stations may be mobile while others may be fixed land based or satellite stations. Omnidirectional antenna systems are preferred in such applications because alternative highly directional antenna systems become difficult to apply, particularly at a mobile station that may communicate with both fixed land based and satellite stations. In such applications it is desirable to provide an omnidirectional antenna system that is characterized further by a wide band width, a good front-to-back ratio, right- or left-handed circular polarization and a compact size.

Some prior art omnidirectional antenna systems use an end fed quadifilar helix antenna for satellite communication and a co-mounted dipole antenna for land based communications. However, each antenna has a limited band width and collectively their performance can be dependent upon antenna position relative to a ground plane. The dipole antenna tends to have a low front-to-back ratio that can cause heavy reflections when the antenna is mounted on a ship, particularly over low elevation angles. These co-mounted antennas also have spatial requirements that can limit their use in confined areas aboard ships or similar mobile stations.

The following patents disclose helical antennas that exhibit some, but not all, the previously described desirable characteristics:

U.S. Pat. No. 3,623,113 (1971) Faigen et al.

U.S. Pat. No. 4,644,366 (1987) Scholz

U.S. Pat. No. 5,134,422 (1992) Auriol

U.S. Pat. No. 3,623,113 to Faigen et al. discloses a balanced, tunable, helical mono-pole antenna that operates independently of a ground plane. This antenna utilizes a centrally fed, multiple-turn, helical antenna with a single element. End winding shorting means in the form of "top hat"- or "can"-type housings tune the antenna by changing the active electrical length of the antenna. A feed loop is centrally disposed to the helical mono-pole antenna winding to provide a balanced input to the antenna. Although this antenna is compact and can be tuned through a wide band width, it does not provide an omnidirectional radiation pattern.

U.S. Pat. No. 4,644,366 to Scholz discloses a miniature radio transceiver antenna formed as an inductor wrapped about a printed circuit card. A peripheral conductor on one side of the card provides distributed capacitance to the end of the antenna that cancels inductive effects and broadens band width. A peripheral conductor on the opposite side of the card provides a capacitance to ground to tune the antenna to frequency. An unbalanced transmission line connects between one end of the antenna and a tap or feed point to provide impedance matching and tuning. This antenna has a limited band width for a given connection point. Moreover it does not produce an omnidirectional radiation pattern.

U.S. Pat. No. 5,134,422 to Auriol discloses an antenna with helically wound, equally spaced, radiating elements disposed on a cylindrical surface. Antennas identified as prior art antennas in this reference include helically wound, end driven antenna elements. The other ends of the elements terminate as open circuits. These antennas provide circular polarization, an omnidirectional radiation pattern and a good front-to-back ratio. The Auriol patent is particularly directed to a structure that uses a conductive, meandering strip to connect the driven ends and establish various phase relationships and tuning. This antenna is designed to produce high quality circular polarization, an omnidirectional radiation pattern and a good front-to-back ratio, but only over a narrow frequency band.

The following patents disclose center-fed spiral antennas that exhibit some, but not all, of the previously described desirable characteristics:

U.S. Pat. No. 4,243,993 (1981) Lamberty et al

U.S. Pat. No. 5,053,786 (1991) Silverman et al

U.S. Pat. No. 4,243,993 to Lamberty et al discloses broad band antennas comprising center feed, spiral antenna arms arranged on planar and conical surfaces. Each antenna arm includes one or more choke elements that resonate at a predetermined operating frequency to eliminate or minimize undesired radiation and reception characteristics and provide sum and difference mode operations with both right-hand and left-hand circularly polarized radiation characteristics. Feeding an antenna as disclosed in the Lamberty et al patent with a phased sequence of signals produces a radiation pattern that exhibits a null along an antenna bore sight axis and a maximum field along a cone of revolution about the bore sight axis. Although this antenna has a broad band width and provides circular polarization, it does not provide an omnidirectional radiation pattern.

U.S. Pat. No. 5,053,786 to Silverman et al. discloses a broad band directional antenna in which two contiguous conductive planar spirals are fed at their center. The antenna is positioned near a cavity to absorb rear lobes in order to improve the front-to-back ratio. Even with this improvement in the front-to-back ratio, the antenna provides a relatively narrow beam pattern having both horizontal and vertical polarization. Apparently, this antenna is designed to operate with a linearly polarized, high gain, narrow beam. Thus the antenna does not provide an omnidirectional radiation pattern or circular polarization. Moreover, by absorbing the rear lobes, the power transmitted into the reserve lobes is lost making the antenna less efficient in radiating during a transmitting mode.

SUMMARY OF THE INVENTION

Therefore it is an object of this invention to provide a broad band omnidirectional antenna.

Another object of this invention is to provide a broad band omnidirectional antenna with good front-to-back ratio.

Yet another object of this invention is to provide a broad band omnidirectional antenna that operates with circular polarization.

Yet still another object of this invention is to provide a broad band omnidirectional antenna that operates with a circular polarization and exhibits a good front-to-back ratio.

Yet still another object of this invention is to provide a broad band omnidirectional antenna that is simple to construct.

In accordance with this invention, an antenna extends along an axis normal to a ground plane and includes a plurality of sets of axially coextensive, serially placed, elongated conductive elements. The serially placed elements in a set lie along one of a plurality of substantially, equally spaced, right helical paths. Individual transmission lines attach to the elements at centrally located, proximate ends for centrally feeding the elements in a set.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
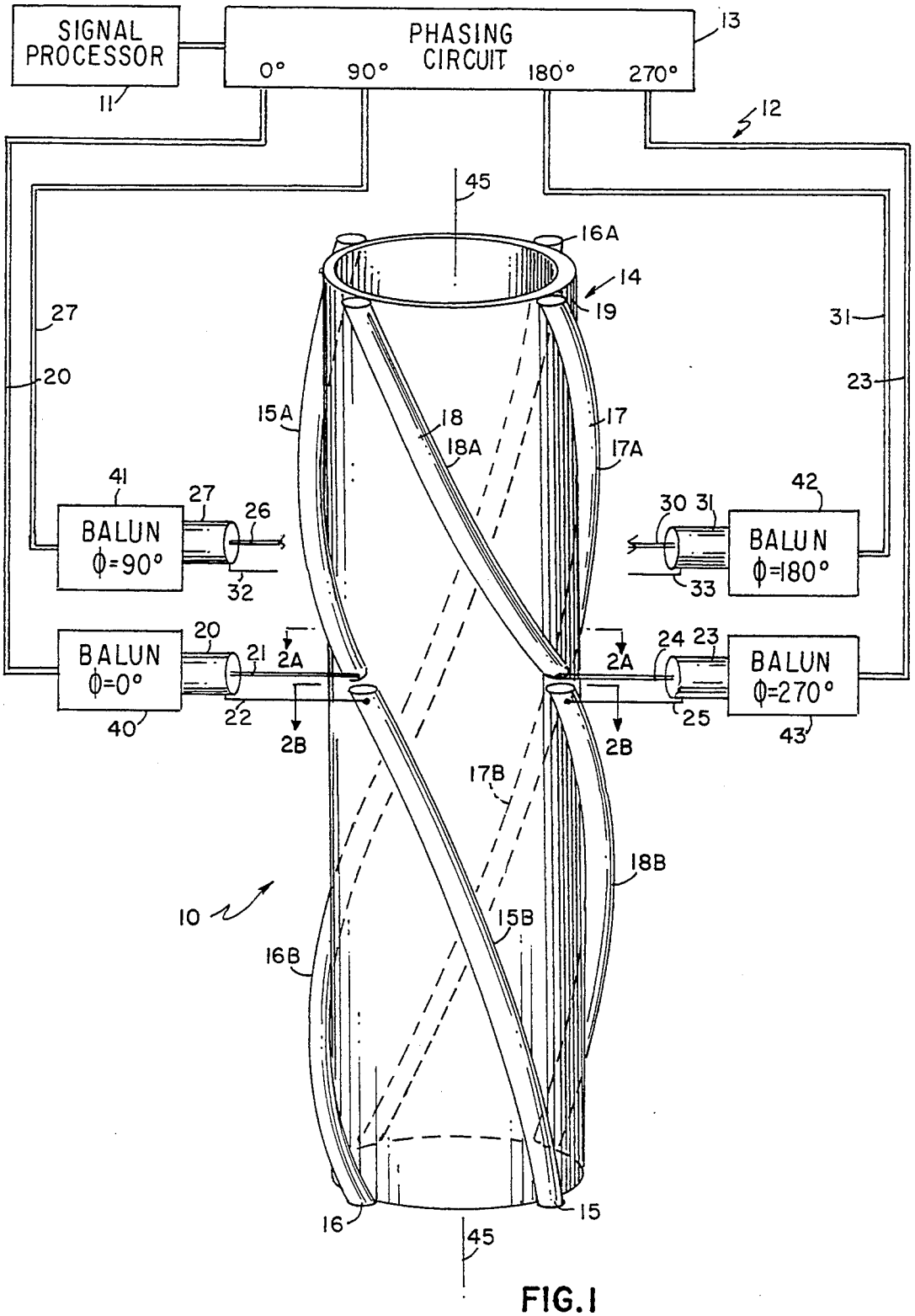
FIG. 1 depicts an antenna system constructed in accordance with this invention.

FIG. 1 depicts, partially in perspective and partially in schematic form, a communications system 10 that includes a signal processor 11 and an antenna system 12 that embodies this invention. As with most communication systems, the signal processor 11 can operate in a transmitting mode, a receiving mode, or alternatively, in a transceiving mode alternately transmitting and receiving. Therefore the signal processor 11, although shown as a block in FIG. 1, is intended to represent appropriate transmitting, receiving or transceiving apparatus. Such equipment is well known in the art so a detailed description of such apparatus and its operation in conjunction with the antenna system of this invention is not necessary for understanding this invention.

Still referring to FIG. 1, the antenna system 12 includes a phasing circuit 13 and an antenna structure 14 that includes a plurality of antenna element pairs. The specific embodiment disclosed in FIG. 1 includes four antenna pairs designated by reference numerals 15, 16, 17 and 18. Each antenna element pair includes two axially spaced elongated conductive antenna elements. For example, the antenna element pair 15 includes an upper antenna element 15A and a lower antenna element 15B; antenna element pairs 16, 17 and 18 include elements 16A, 16B, 17A, 17B, 18A and 18B respectively. This particular embodiment utilizes four such antenna element pairs; the number of pairs, N, can vary so long as the antenna 11 includes at least two pairs (i.e., $N \geqq 2$). As a practical matter, the number of pairs generally will be between 2 and 16 (i.e., $2 \leqq N \leqq 16$).

Each antenna element pair, such as antenna element pair 15 lies along the path of a right helix for some number, M, turns on a cylindrical support 19. In this particular embodiment antenna element pair 15 lies along a helical path of $\frac{1}{2}$ turn over the overall length of the antenna 14 so $M=0.5$. If it is desired to produce an antenna with an omnidirectional pattern, the number of turns should be one or less (i.e., $\frac{1}{8} \leqq M \leqq 1$). If $M>1$, then the antenna becomes more directional. Such operation would be beneficial for applications in which the angle of reception or transmission was fixed.

Each antenna element pair has a central feed point for connection to the other circuitry. Specifically, a balanced feed transmission line 20 connects by means of a conductor 21 to the antenna element 15A and by means of a conductor 22 to the antenna element 15B. The feed points are located at the central proximate ends of the elements in an antenna element pair, such as elements 15A and 15B. The other end, or free end, of each antenna element terminates in an open circuit. In essence the antenna element pair 15 is a helical dipole, i.e., a dipole laid along a helical path.

Similar connections are made to the other antenna element pairs. For purposes of clarity only one additional element connection is shown in FIG. 1. That is a connection provided from a transmission line 23 by which a conductor 24 connects to the upper antenna element 18A while another conductor 25 connects to the center point of the lower element 18B.

Figure 2A:
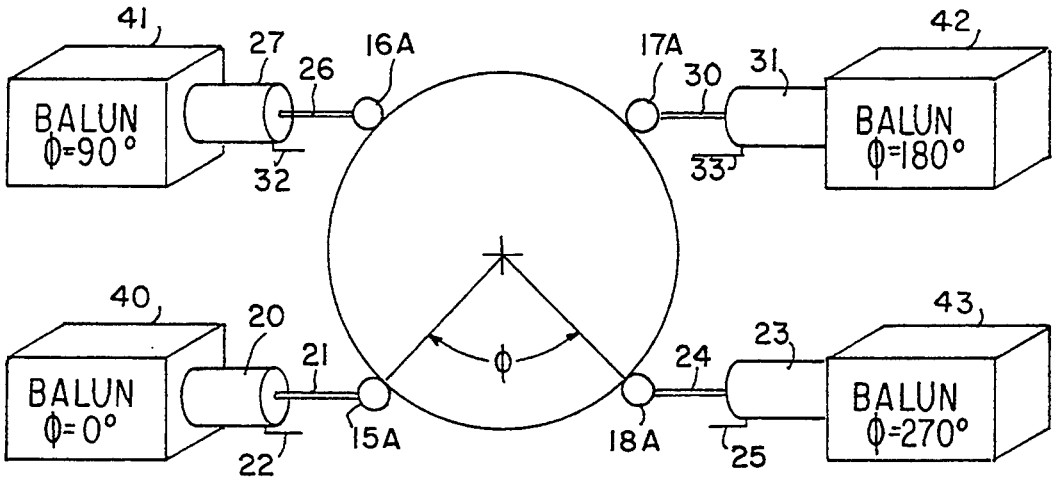
FIGS. 2A and 2B are two views of the antenna structure shown in FIG. 1 with partial cross sections taken along lines 2A—2A and lines 2B—2B respectively.
Figure 2B:
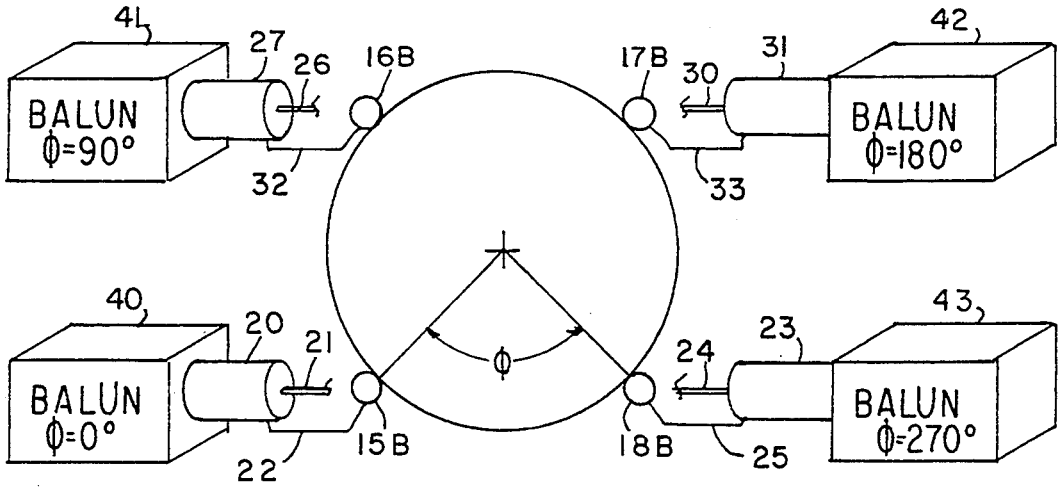

FIG. 2A also discloses connections between the conductors 21 and 24 and antenna elements 15A and 18A. A conductor 26 of a transmission line 27 connects to antenna element 16A; a conductor 30 of a transmission line 31, to the antenna element 17A. As previously indicated, these connections are made at the mid point of each antenna element pair (i.e., at the bottom of the upper antenna elements 15A, 16A, 17A and 18A of FIG. 1). FIG. 2B depicts the connection of the conductors 22 and 25 to the antenna elements 15B and 18B. A conductor 32 from the transmission line 27 connects to the antenna element 16B; and a conductor 33 of the transmission line 31, to the antenna elements 17B.

Thus the antenna structure shown in FIG. 1 comprises four helically wrapped dipole antennas and four separate transmission lines that centrally feed each dipole. Stated generally, the antenna comprises dipoles along N helical paths for being driven by N transmission lines. As will be more apparent by reference to FIGS. 2A and 2B, the spatial angle of $\phi$ is determined by the number, N, of antenna element pairs. Specifically:

$$\phi = \left(\frac{360}{N}\right)^{\circ} \tag{1}$$

This spatial angular spacing also corresponds to the phase difference of signals applied by the phasing circuit 13 to the various antenna element pairs. In the specific embodiment shown in FIG. 1, the phasing circuit produces the fundamental signal on a transmission line 20 and phase signals delayed by 90°, 180° and 270° on conductors 27, 31 and 23 respectively. Transmission lines 20, 23, 27 and 31 are typically unbalanced lines, such as coaxial conductors. Baluns 40 through 43 are utilized with the transmission lines 20, 27, 31 and 23 respectively to produce a balanced feed at the connection of each transmission line to its corresponding antenna element pair. Baluns are well known in the art for providing unbalanced to balanced signal conversion.

Although baluns can take many forms, it has been found that a balun formed by wrapping at least one turn of a coaxial cable around an annular ferrite core provides an appropriate unbalanced to balanced conversion.

The balanced signals from the phasing circuit are applied in sequence to the various element pairs in a direction corresponding to the rotation of the conductors. That is, while the fundamental signal from the 0° balun 40 on the transmission line 20 is applied to the antenna element pair 15, the phase delayed signals from baluns 41, 42 and 43 for the transmission lines 27, 31 and 23 are applied to the antenna element pairs 16, 17 and 18 respectively in sequence. When viewed in the position shown in FIG. 1, both the rotation of the helix and the application of phase are to the left, or clockwise with respect to a helix axis 45.

With appropriate sizing of the various components, the resulting antenna is characterized by an omnidirectional radiation pattern, a wide frequency band, a good front-to-back ratio and good structure. A further understanding of the advantages of this invention can be more fully attained by referring to the design and construction of a specific antenna embodiment utilizing this invention. In the particular embodiment shown in FIG. 1, the antenna comprises four element pairs (i.e., N=4) and each antenna element pair revolves by ½ turn about the axis 45 (i.e., M=0.5). Typically the antenna will have an overall length along the axis of about ½ wavelength to one wave length at the center frequency.

An antenna for operating in the frequency band from 240 Mhz to 400 Mhz has been constructed with a nominal axial length of 18 inches, that approximates 0.5λ where $\lambda_0$=36.9 inches for a mid frequency, $f_0$=320 Mhz. If the antenna has a greater length, gain will improve as will the size of the antenna structure. It is anticipated most antennas will be constructed having an axial length of $0.5\lambda_0$.

Increasing the number, N, of elements will increase the gain of the antenna, but decrease its band width.

The antenna diameter, D, normally is selected to be less than 0.3 $\lambda_0$. In this particular embodiment the overall diameter is selected to be 0.15 $\lambda_0$. The radius, "a" of the elements is also selected to be less than $0.01\lambda_0$. In this particular application the antenna 14 has an overall diameter of 5.5 inches and each of the elements has a diameter of 0.5 inches.:

$$a=0.25<0.01\lambda_0 \quad (2)$$

With these particular dimensions the antenna system 12 has a diameter of 6.5 inches. The value of "a" has no effect on the overall performance of the antenna, but does change the impedance of the antenna. The diameter, D, will change the pitch angle and this can impact gain and band width.

The pitch angle for the helix is given by:

$$\alpha = \tan^{-1}\left(\frac{L}{\pi MD}\right) = 64.4° \quad (3)$$

The length of an antenna element pair for a given antenna, T, is given by:

$$T = \frac{L}{\sin\alpha} = 19.6'' \quad (4)$$

Figure 3:
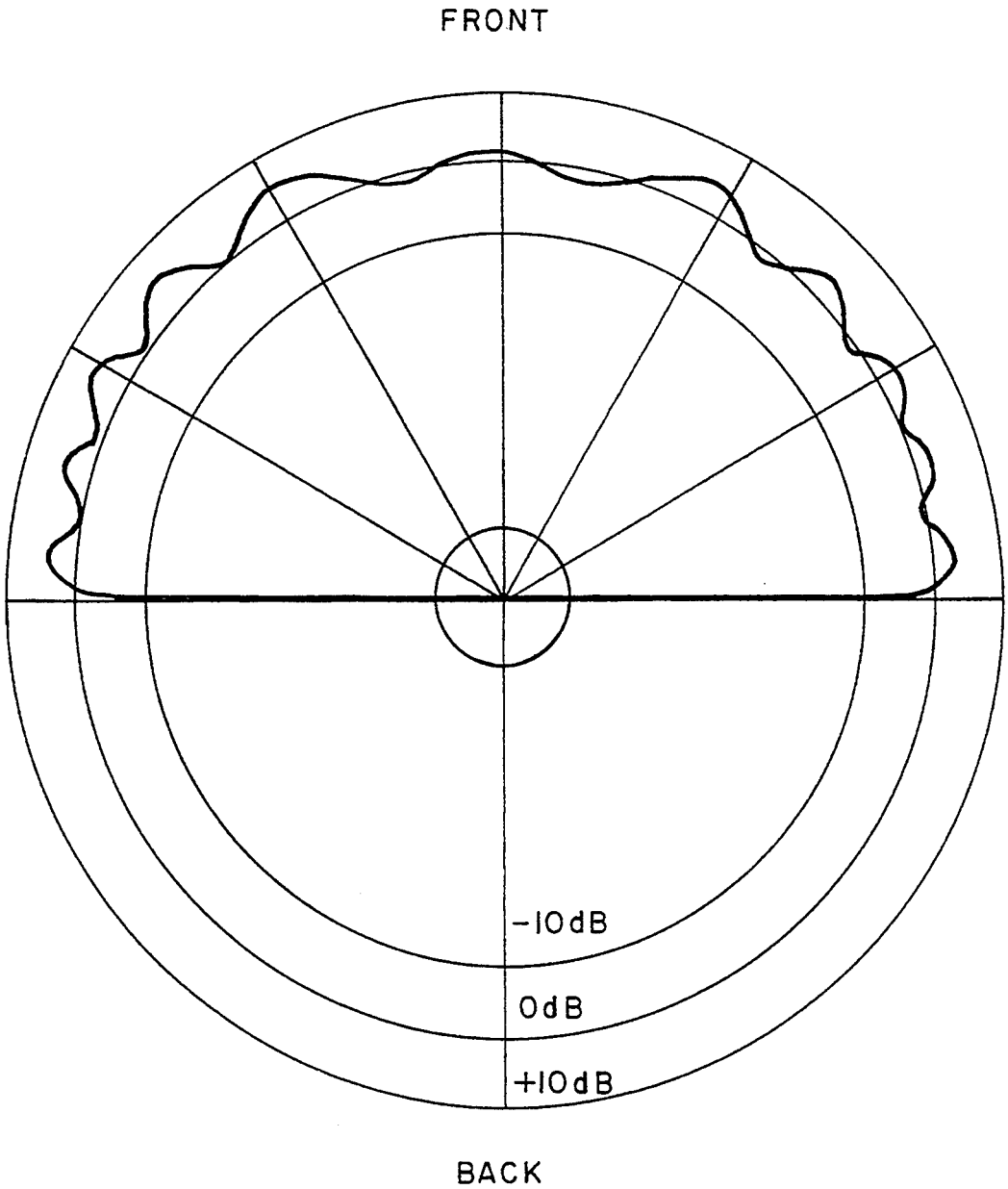
FIG. 3 depicts antenna response for a particular embodiment of this invention.

FIG. 3 depicts the performance of the antenna constructed in accordance with these dimensions for $\lambda_0$=320 Mhz when the axis 45 is positioned as shown in FIG. 1 to be vertical in space. The top of the antenna, formed by the free ends of the antenna elements 15A through 18A, constitutes the front of the antenna. As will be apparent from viewing FIG. 3, the radiation pattern has a substantially equal gain for essentially the hemisphere above the ground plane. This particular plot depicts performance when the antenna is located approximately 9 feet above sea water. The power gain for the antenna only varies by about 3 dB when the frequency varies from 240 to 400 Mhz. Moreover, the variations remain within 3 dB over that band width as the antenna position is displaced from 9 through 12 feet above a ground plane, such as sea water. Consequently the antenna shown in FIG. 1 and constructed in accordance with this specific dimension described above meets all the objectives of this invention. The antenna covers a broad frequency band. It is omnidirectional in a hemisphere above the earth as a ground plane. It has a good front-to-back ratio with essentially all power radiating forwardly of the antenna. Finally, it is relatively insensitive to its position or displacement relative to a ground plane.

This invention has been described in terms of a specific embodiment. Various modifications can be made with respect to the number of antenna element pairs, the antenna diameter, length and other features. The effect of varying each of the important parameters has been established. Therefore, it is the intent of the appended claims to cover all such variations and modifications as come within the true spirit and scope of this invention.

What is claimed is:

1. An antenna extending along an axis for operating with respect to a ground plane and for connection to a signal processor operating at a characteristic center frequency with a plurality of phased signals, said antenna comprising:

a plurality of sets of axially coextensive elongated conductive antenna elements, each said antenna element in a set lying along one of a plurality of substantially equally spaced right helical paths about a helix axis and being proximate at a center point along the helical path, said antenna having a length along the helix axis of between about ½ wavelength and one wavelength at the characteristic center frequency, and balanced feed transmission means of connected to each said set of conductive antenna elements at the center point for transferring individual phased signals between the signal processor and each said set of antenna elements at each said center point.

2. An antenna as recited in claim 1 wherein the plurality of antenna element sets and plurality of phase signals are equal.

3. An antenna as recited in claim 2 wherein said plurality of antenna element sets and phase signals are in the range of 2 through 16.

4. An antenna as recited in claim 2 wherein each said antenna element has a free end that is remote from the said center point and is open circuited.

5. An antenna as recited in claim 2 wherein each of said antenna elements has a left-handed rotation whereby said antenna operates with a right-handed circular polarization.

6. An antenna system for radiating a signal from and receiving signals for signal processing means operating at a characteristic center frequency, said antenna system comprising:

an antenna including a right cylindrical support and a plurality of axially coextensive elongated conductive antenna elements, each said antenna element being attached to said cylindrical support along one of a plurality of substantially equally spaced helical paths about a helix axis and having an element center point, said antenna having a length along the helix axis of between about $\frac{1}{2}$ wavelength and one wavelength at the characteristic center frequency, and phase conversion means intermediate the signal processing means and said antenna elements and having one connection with the signal processing means and a plurality of balanced feed transmission connections to individual antenna element center points.

7. An antenna system as recited in claim 6 wherein said plurality of elements and said plurality of phase conversion connections to said antenna are equal.

8. An antenna system as recited in claim 7 wherein the signal processing means includes means for transmitting a signal to said antenna system, said phase conversion means splitting the signal into the plurality of equally spaced phase signals for transfer to said antenna elements.

9. An antenna system as recited in claim 7 wherein the signal processing means includes means for receiving a signal from said antenna system, said phase conversion means combining the phase signals from said antenna elements into a signal for transfer to the receiving means.

10. An antenna system as recited in claim 7 wherein said plurality of antenna elements and phase signals are in the range of 2 through 16.

11. An antenna system as recited in claim 7 wherein each said antenna element has a free end that is remote from the said center point and is open circuited.

12. An antenna system as recited in claim 7 wherein each of said antenna elements has a left-handed rotation whereby said antenna operates with a right-handed circular polarization.

* * * * *